US008826708B2

(12) United States Patent
Lopes

(10) Patent No.: US 8,826,708 B2
(45) Date of Patent: Sep. 9, 2014

(54) LOCKING MECHANISM

(71) Applicant: Antonio Jorge Freire Lopes, Sao Paulo (BR)

(72) Inventor: Antonio Jorge Freire Lopes, Sao Paulo (BR)

(73) Assignee: Unikey Componentes Industrials Ltda., Cotia/SP (BR)

( * ) Notice: Subject to any disclaimer, the term of this patent is extended or adjusted under 35 U.S.C. 154(b) by 0 days.

(21) Appl. No.: 13/775,371

(22) Filed: Feb. 25, 2013

(65) Prior Publication Data

US 2013/0219976 A1 Aug. 29, 2013

(30) Foreign Application Priority Data

Feb. 24, 2012 (BR) ..... 2020120040196

(51) Int. Cl.

| | |
|---|---|
| ***E05B 3/00*** | (2006.01) |
| ***E05C 1/06*** | (2006.01) |
| ***E05B 81/10*** | (2014.01) |
| ***E05B 1/00*** | (2006.01) |
| ***E05C 9/04*** | (2006.01) |
| ***E05B 83/16*** | (2014.01) |
| ***E05B 13/10*** | (2006.01) |
| ***E05B 83/22*** | (2014.01) |
| ***E05B 81/04*** | (2014.01) |
| *E05B 51/02* | (2006.01) |
| *E05B 47/02* | (2006.01) |

(52) U.S. Cl.

CPC ..... *E05B 83/16* (2013.01); *E05B 81/10* (2013.01); *E05B 1/0038* (2013.01); *E05C 9/046* (2013.01); *E05B 51/02* (2013.01); *E05B 13/105* (2013.01); *E05B 83/22* (2013.01); *E05B 47/02* (2013.01); *E05B 81/04* (2013.01); *Y10S 70/20* (2013.01)

USPC ..... 70/387; 70/DIG. 20; 292/336.3

(58) Field of Classification Search

USPC ..... 70/79, 208, 360, 387, 275, 279.1; 292/38, 50, 336.3

See application file for complete search history.

(56) References Cited

U.S. PATENT DOCUMENTS

| | | | | |
|---|---|---|---|---|
| 1,174,652 | A * | 3/1916 | Banks | 292/36 |
| 3,834,780 | A * | 9/1974 | McClellan et al. | 70/82 |
| 4,601,499 | A * | 7/1986 | Kim | 292/36 |
| 4,951,486 | A * | 8/1990 | Braun et al. | 70/208 |
| 6,231,091 | B1 * | 5/2001 | Gleason et al. | 292/34 |
| 6,343,494 | B2 * | 2/2002 | Roos et al. | 70/264 |
| D472,449 | S * | 4/2003 | Weinerman et al. | D8/330 |
| D474,673 | S * | 5/2003 | Weinerman et al. | D8/330 |
| 6,899,362 | B1 * | 5/2005 | Weinerman et al. | 292/336.3 |
| 7,516,632 | B2 * | 4/2009 | Poppell | 70/279.1 |
| 2011/0185779 | A1 * | 8/2011 | Crass et al. | 70/158 |

* cited by examiner

*Primary Examiner* — Christopher Boswell

(74) *Attorney, Agent, or Firm* — William J. Sapone; Ware Fressola Maguire & Barber LLP

(57) ABSTRACT

A locking mechanism (1) responsible for moving crossed rods for locking a door or compartment of a vehicle such as a bus, has a main cylinder (2), a fixed base (3) and articulated arms (4) equipped with rod holders (4.1). The locking mechanism herein being substantially more compact and efficient than similar mechanisms in terms of application and functionality, as the locking mechanism avoids rotating parts in the mechanism for effecting locking and unlocking, instead relying on a push/pull activation which provides many advantages.

5 Claims, 7 Drawing Sheets

LOCKING MECHANISM

TECHNICAL FIELD

The invention relates to a novel locking mechanism, which consists of a locking mechanism responsible for the activation of crossed rods, the whole system, including the mechanism and crossed rods, preferably being used on luggage doors of large vehicles, such as, for example, buses and the like.

The locking mechanism herein disclosed is substantially more compact and efficient, in terms of functionality and implementation, than similar mechanisms belonging to the current state of the art.

BACKGROUND ART

The current state of the art consists of a huge range of locking mechanisms, which are intended mainly to enable a mobile wall or door to be securely locked and opened only by authorized persons. Currently existing locking mechanisms are used in distinct and specialized applications, while the principle of operation varies according to the different "groups" of locking mechanisms.

Among the existing locking mechanisms, we highlight the locking mechanisms responsible for the activation of "crossed rods", which comprise locking systems where the locking elements (pins and locks in general) are located at some distance from their respective locking mechanisms. Thus, the aforementioned "crossed rods" are meant to transmit the motion of locking or opening of the locking mechanism to the locking elements.

These locking mechanisms are conventionally used on luggage doors or cargo compartments of large automotive vehicles, such as, for example, buses in general. The operating principle of this type of locking mechanism is particularly suited for this application, as the locking mechanism itself is usually fixed centrally on the inner face of a luggage door, while the closure elements are located at the edges of the luggage door. The crossed rods will then enable the opening and closing "commands" to be mechanically transmitted from the locking mechanism to the closing elements.

An example of this type of locking mechanism is fully described in the applicant's prior Brazilian Patent Application no. MU 8700113-6, which was filed on 16 Jan. 2007.

The application describes a locking mechanism for luggage doors formed by the combination of a drive module and a locking module, activated by a system of rods. As mentioned before, the drive module has the function of receiving the rotational opening and closing movement, and to transmit said rotational opening and closing motion to the locking module, ensuring the locking of the door.

The drive module, also known as the locking mechanism, is entirely based on a rotary movement, and as a result, it is fundamentally composed of a fixed body and a movable body, both associated with the internal face of the "mirror" of the lock.

The fixed body is basically composed of the "cylinder" of the lock, which is connected to a sliding arm, and said arm in turn is connected to a rod articulator which is a movable body.

The articulator consists of a modular structure provided with at least two "rods holders", being fixed pivotally and centrally to the internal face of the "mirror" of the lock.

When the "cylinder" of the lock is activated, the sliding arm is moved, thus moving the rod articulator. This small rotational movement of the rod articulator is sufficient to alter the course of the rods which are associated to the locking elements, locking or unlocking the luggage door.

Although the object of the prior Brazilian Patent Application MU 8700113-6 fulfills all the functions to which it was originally designed, it can be seen that it has aspects that can be improved and optimized. These aspects are all related to the integration of modules and parts that integrate the lock, after all, all modules and parts are associated together by highly complex mechanical extenders, and any disassociation between these modules and parts ends up with the destruction of the lock.

Notably, the lock or locking mechanism disclosed in the Brazillian Patent Application MU 8700113-6 comprises an example of a locking mechanism responsible for the activation of "crossed rods", however, most of the existing locking mechanisms are likely to have the same aforementioned aspects that may need improvements.

Yet another negative aspect related to the current locking mechanisms mentioned above refers to the operation of opening and closing. In this concept, it can be observed that such mechanisms are always linked to an external "handle" that must be pulled to activate the aforementioned opening or closing of the luggage door. This "pulling" movement should be executed in the same direction of the door opening, which sometimes can be a great inconvenience due to lack of space sufficient to pull the "handle" and open the door, or due to the ergonomic complexity of the full movement when done by one person. Based on this scenario, the present invention was developed.

SUMMARY OF THE INVENTION

In order to optimize aspects that may be improved in the locking mechanisms belonging to the current state of the art, this invention was developed, which discloses a novel constructive disposition introduced in a locking mechanism.

The locking mechanism of the present invention provides unprecedented constructiveness, which is able to mitigate problems and/or the negative aspects explained above. Therefore, the locking mechanism disclosed herein comprises a compact and integrated constructiveness, the constructiveness being without parts or mechanisms of circular motion, and therefore, without the complex mechanical extenders in current use.

Furthermore, the novel constructiveness of the locking mechanism herein disclosed is responsible for the optimization of the door opening movement to which it is associated. Thus, the locking mechanism herein disclosed drives the locking elements through a "push" movement, i.e., a counter movement to the movement applied to similar mechanisms belonging to the current state of the art. This embodiment voids any space problems and ergonomic problems related to the opening of luggage doors of large automotive vehicles, such as in the case of busses.

BRIEF DESCRIPTION OF THE DRAWINGS

The present invention will be described in detail based on the figures listed below, in which.

DETAILED DESCRIPTION OF THE INVENTION

Figure 1:
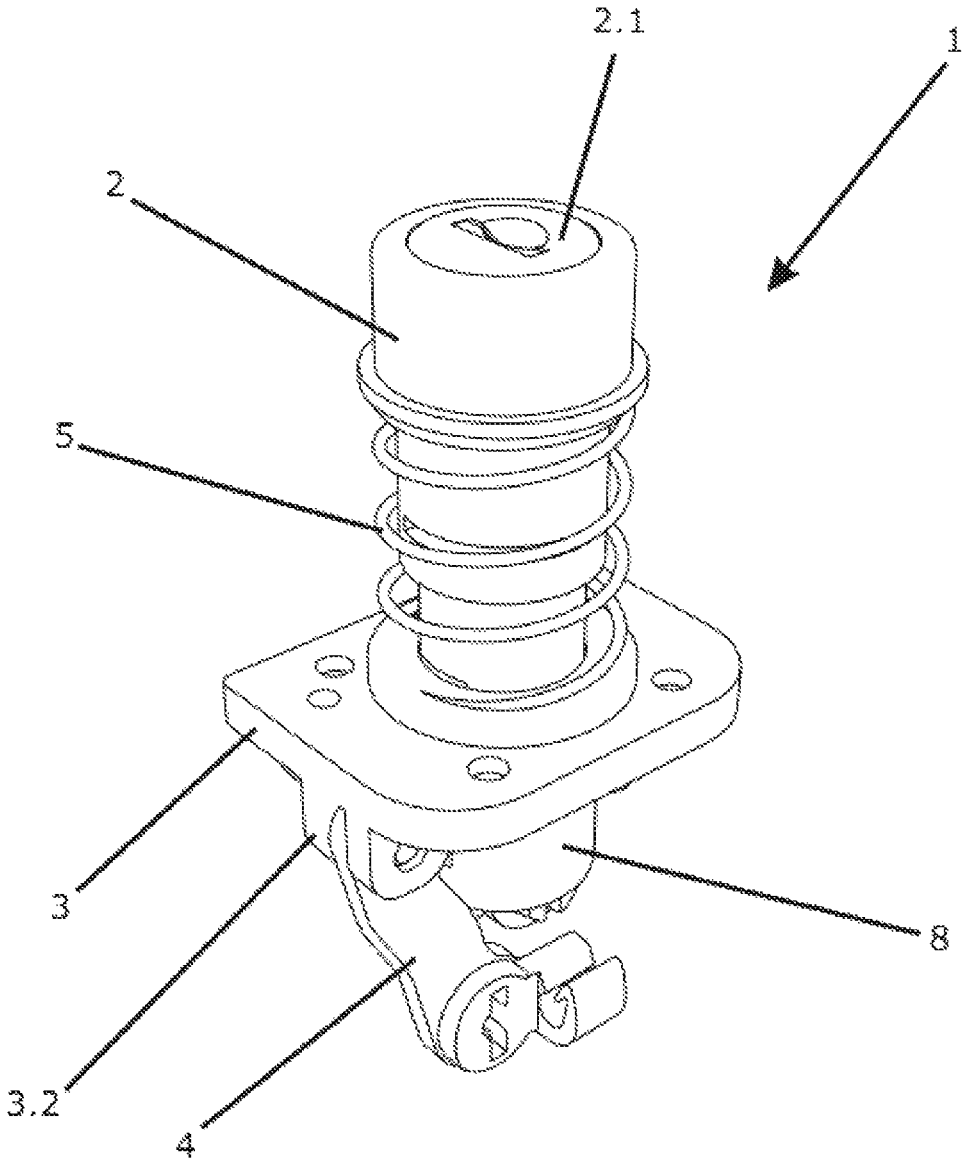
FIG. 1 illustrates the locking mechanism herein disclosed, seen in an isometric perspective view.
Figure 2:
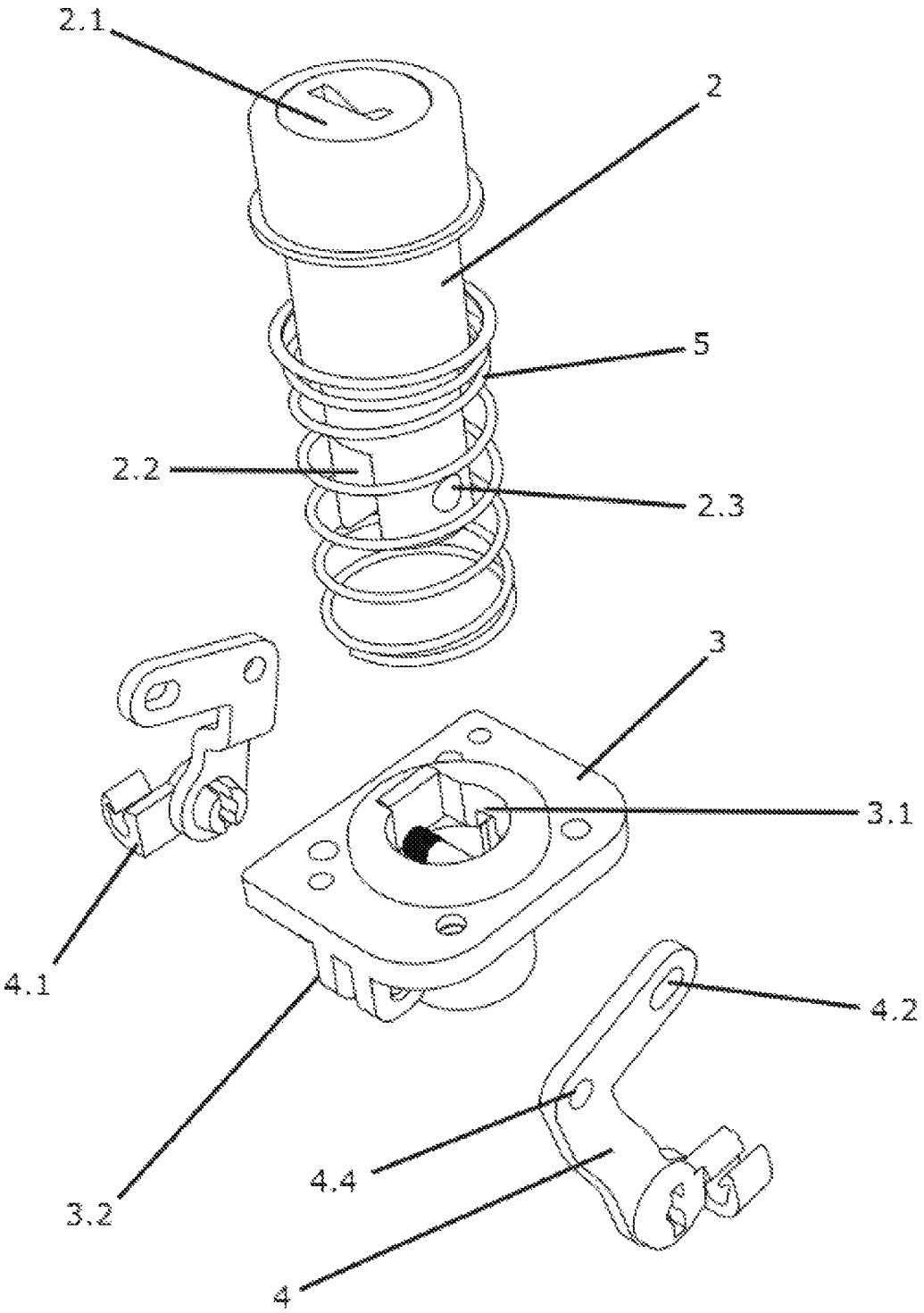
FIG. 2 illustrates the locking mechanism herein disclosed, seen in an exploded perspective.
Figure 3:
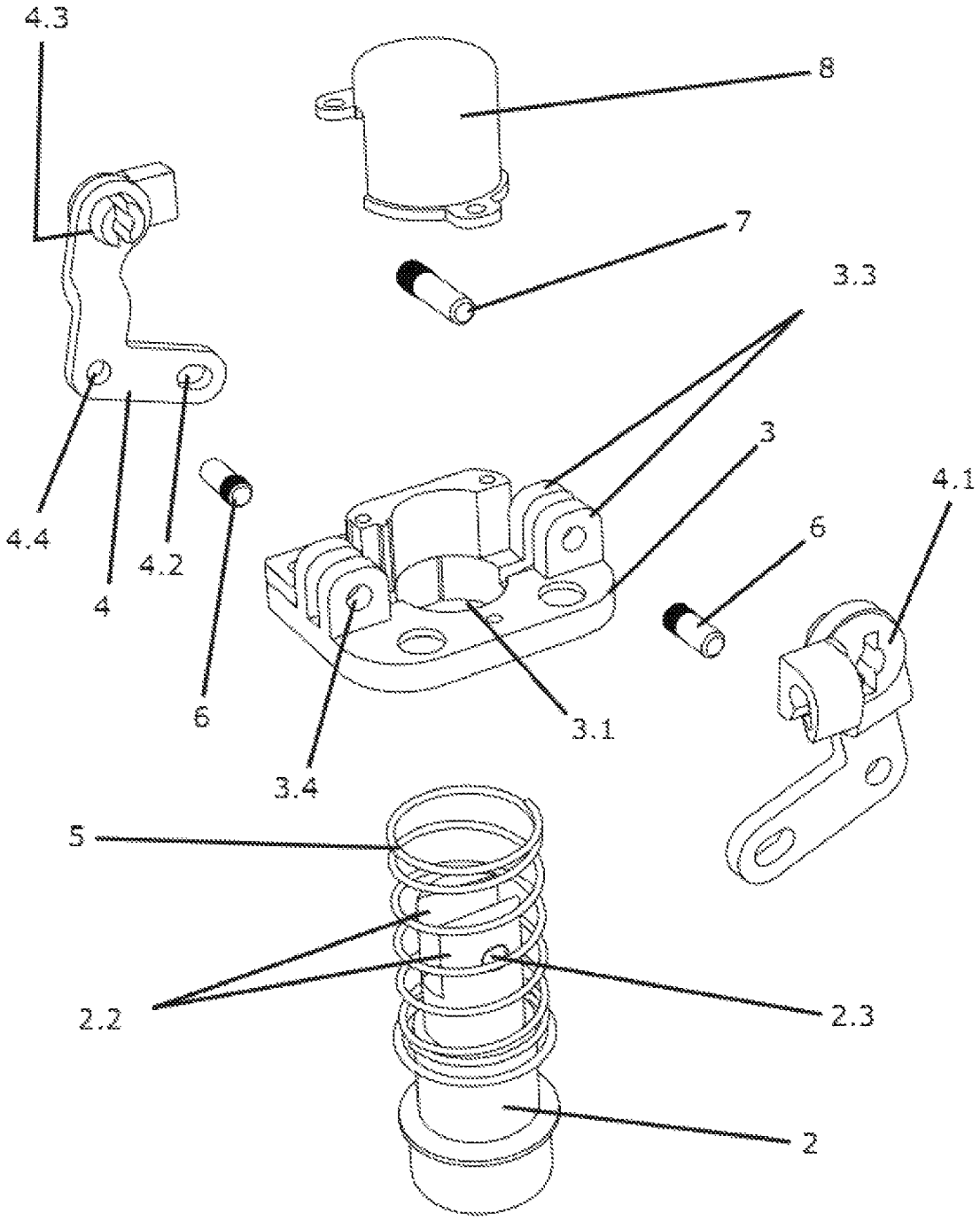
FIG. 3 illustrates the locking mechanism herein disclosed, seen in a second exploded perspective.
Figure 4:
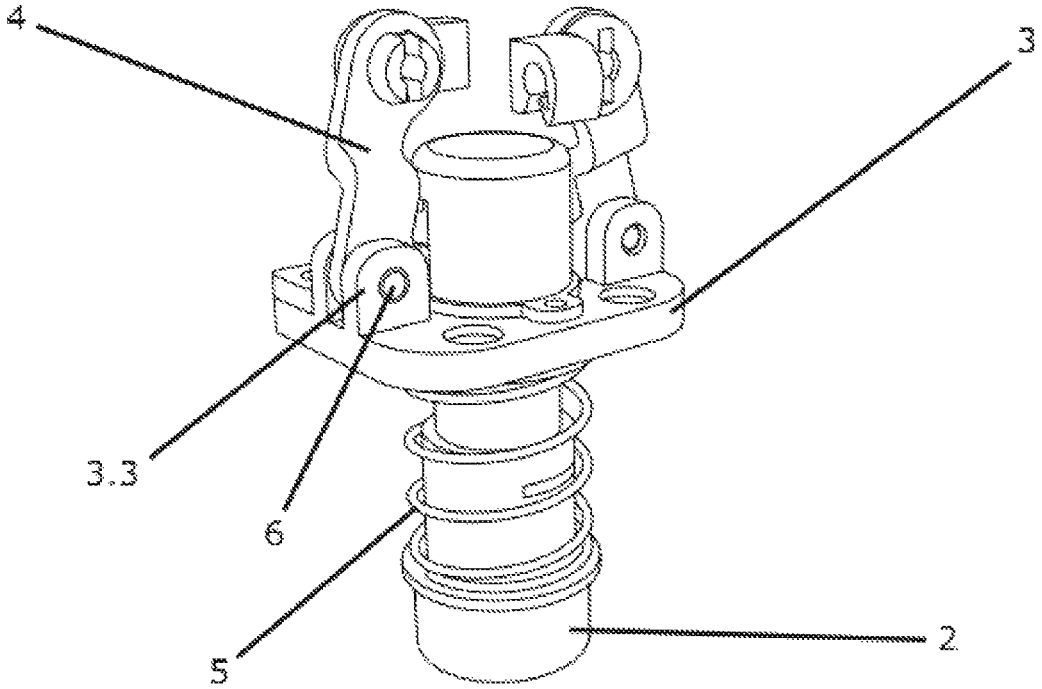
FIG. 4 illustrates the locking mechanism herein disclosed, seen in perspective in an initial position.
Figure 5:
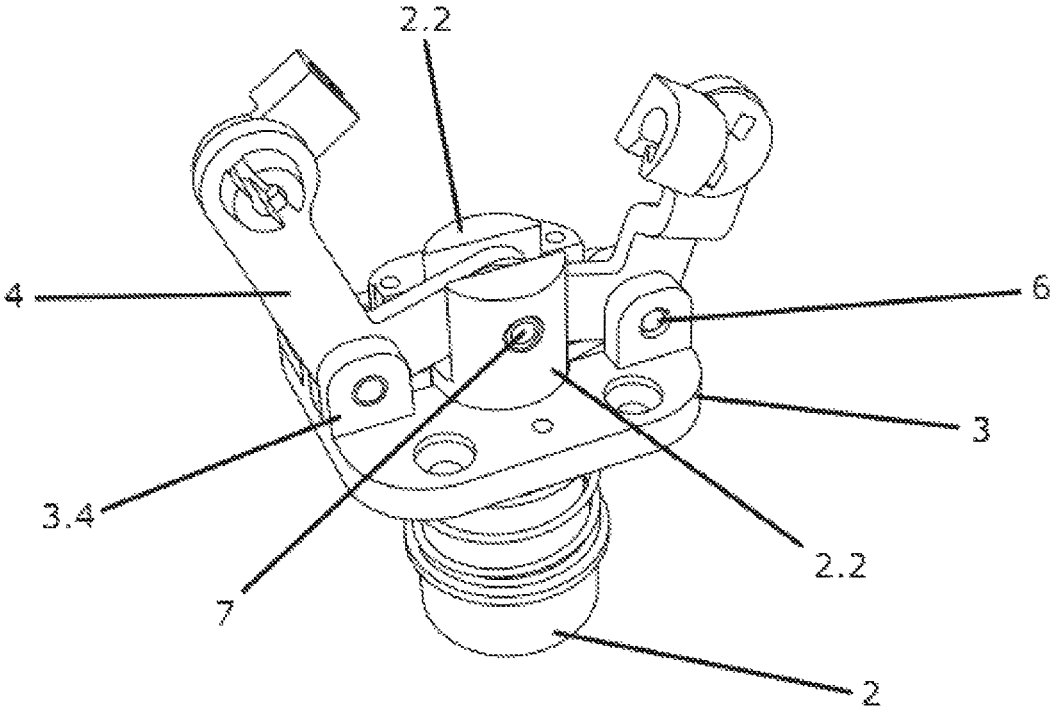
FIG. 5 illustrates the locking mechanism herein disclosed, seen in perspective in a drive position.
Figure 6:
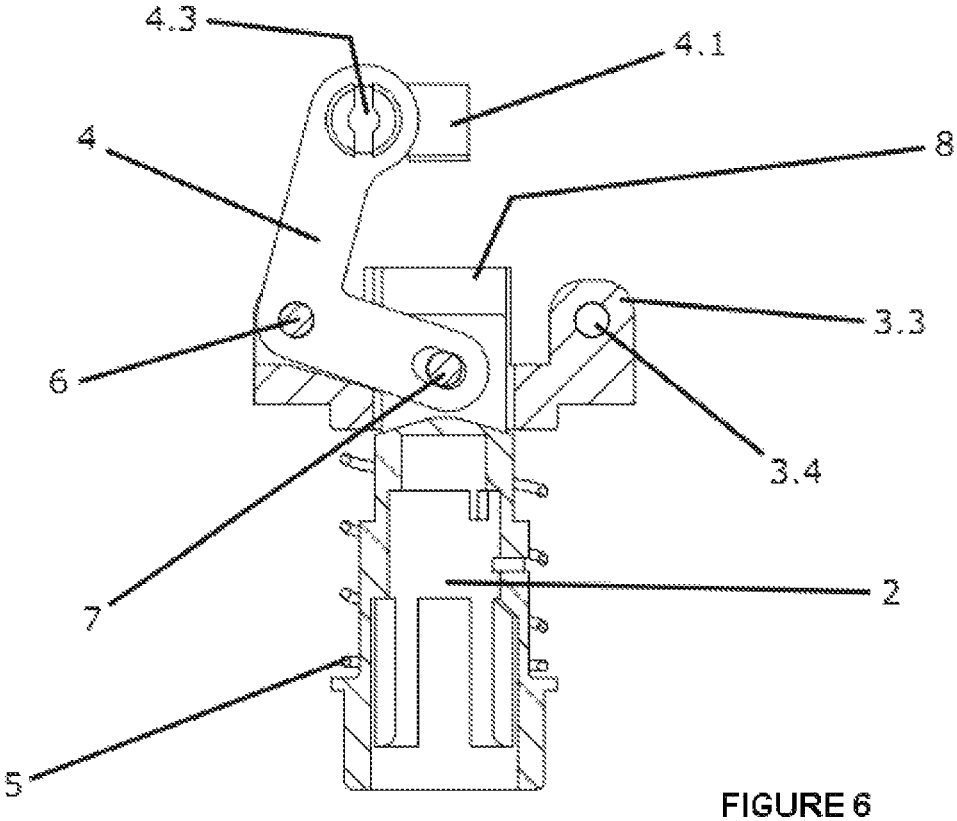
FIG. 6 illustrates the locking mechanism herein disclosed, seen in a schematic section in the initial position.
Figure 7:
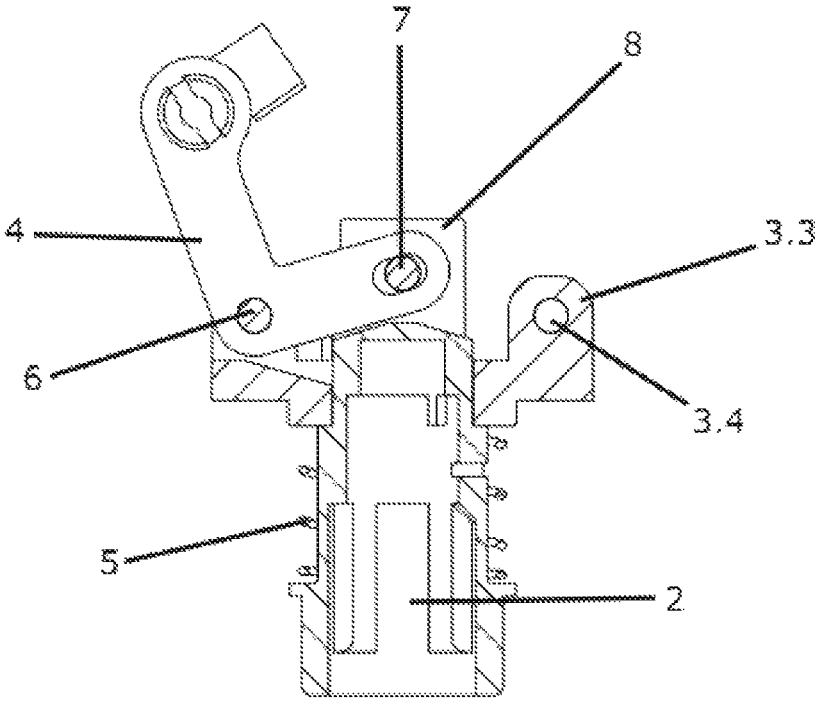
FIG. 7 illustrates the locking mechanism herein disclosed, seen in a schematic section in the drive position.

The present invention provides three versions of the locking mechanism herein disclosed, one of them being a basic and fundamental version of a local drive, and two versions based on the basic and fundamental version, with additional mechanisms that allows local and remote activation.

Description of the Basic Version of the Locking Mechanism

With reference to FIGS. 1, 2, 3, 4, 5, 6 and 7, it can be noticed that the basic and fundamental version of the locking mechanism, hereafter referenced only as the mechanism (1), is fundamentally composed of a main cylinder (2), a fixed base (3) and articulated arms (4) equipped with rod holders (4.1).

The main cylinder (2) consists of a cylindrical body, partially tubular, preferably suitable for the optional reception of a core lock (2.1). One end of the main cylinder (2), the opposite end to the end suitable for receiving the core lock, incorporates a diametrically disposed slot, forming two semicircular walls (2.2) which are preferably solid.

Each of the semicircular walls (2.2) incorporates a latitudinal passing hole (2.3). Notably, the holes (2.3) of the semicircular walls (2.2) are aligned.

The fixed base (3) consists preferably of a monobloc body provided with a centrally disposed hole (3.1) of circular contour. One face of the fixed base (3) further incorporates two articulation tabs (3.2), which are arranged in alignment and spaced apart through the hole (3.1).

Preferably, each articulation tab is formed by two parallel walls (3.3) spaced by a gap, and each of the parallel walls (3.3) incorporates a latitudinal passing hole (3.4). Notably, the holes (3.4) of a same articulation tab are aligned to each other.

The articulated arms (4)—existing in pairs—comprise bodies with an "L" shaped profile, that is, each articulated arm (4) comprises a "horizontal" extension followed by a "vertical" portion. Each of the articulated arms (4) has three through holes (4.2), (4.3) and (4.4).

The through hole (4.2) is essentially oblong and formed at one end of the articulated arm (4). The through hole (4.3) is essentially circular and disposed at the other end of the articulated arm (4). The through hole (4.4) is essentially circular and disposed at the center, that is, the region in which there is a ninety-degree curve which defines the "L" shaped profile of the articulated arm (4).

As previously mentioned, the through holes (4.2) of the articulated arms (4) are intended for the reception of the rod holders (4.1), which are similar to the rod holders described in the Brazilian Patent MU 8700113-6.

Assembling the Basic Version of the Locking Mechanism

In a coherent assembly of the mechanism (1), the main cylinder (2) is inserted into the hole (3.1) of the fixed base (3). A spring (5) or another resilient element is associated to the main cylinder (2) and to the fixed base (3), allowing the automatic return of the main cylinder (2) when it is pressed during the activation of the mechanism (1).

The articulated arms (4) are physically associated to the fixed base (3). Specifically, the through hole (4.4) of each arm (4) is linked to one of the articulation tabs (3.2) of the fixed base (3). Preferably, the association between the through hole (4.4) of each arm (4) and its respective articulation tab (3.2) takes place by way of a cylinder (6), which is introduced between the holes (3.4) of the parallel walls (3.3) that compose the articulation tabs (3.2). Consequently, the cylinder (6) also passes through the through hole (4.4) of the articulated arms (4). Preferably, the cylinder (6) is locked in its respective articulation tab (3.2) through a crimping method (deformation under mechanical pressure).

Thus, a portion of each of the articulated arms (4) remains housed inside the slot of the main cylinder (2) between the semi-circulars walls (2.2). In this situation, the through holes (4.2) of both articulated arms (4) are aligned to each other and aligned with the holes (2.3) of the semi-circular walls (2.2) of the main cylinder (2). All these holes are passed through by a cylinder (7), which is locked to the components and which finally maintains the cohesion between them. The cylinder (7) is preferably locked to the through holes (4.2) and (2.3) through a crimping method (deformation under mechanical pressure).

Finally, the fixed base (3) is fixed to a door (not shown) and "crossed" rods (not shown) are associated to the rods holders (4.1) and to the locking elements (not shown).

Optionally, a protective cover (8) is provided with an essentially cylindrical shape, which is mounted above the hole (3.1) of the fixed base (3), protecting the articulation tabs (3.2) and part of the articulated arms (4).

This assembly, which is only obtained according to the constructiveness of the mechanism (1), is free of mechanical movement extenders, resulting in a more functional and safer mechanism (1) than the mechanisms belonging to the current state of the art.

Operation of the Basic Version of the Locking Mechanism

It can be intuitively observed that the operation of the mechanism (1) is simple, practical and efficient.

The entire operation is based on the movement of the main cylinder (2) in relation to the fixed base (3). When the main cylinder (2) is "pushed", always in relation to the fixed base (3), the semicircular walls (2.2) are displaced, and this displacement culminates in the articulation of both articulated arms (4) and the consequent movement of the "crossed" rods (not shown) that activate the locking elements (also not illustrated).

It should be noted that the main cylinder (2) is "pushed" by a local manual action, that is, physical pressure, i.e., applied by local activation.

When the main cylinder (2) is "loosened", that is, there is an absence of physical pressure, it tends to return to its initial position due to the action of the spring (5), thereby promoting reverse articulation to the articulations described above. The reverse articulation culminates, obviously, in the regression of all the components of the mechanism (1) to its original state, which includes the positioning of the "crossed" rods (not shown) and the positioning of the locking elements (also not shown).

Notably, this operation is not based on a rotational motion, but by the articulation movement of the articulated arms (4), imposed by the displacement of the main cylinder (2) with respect to the fixed base (3).

Description of the First Optional Version of the Locking Mechanism

Figure 8:
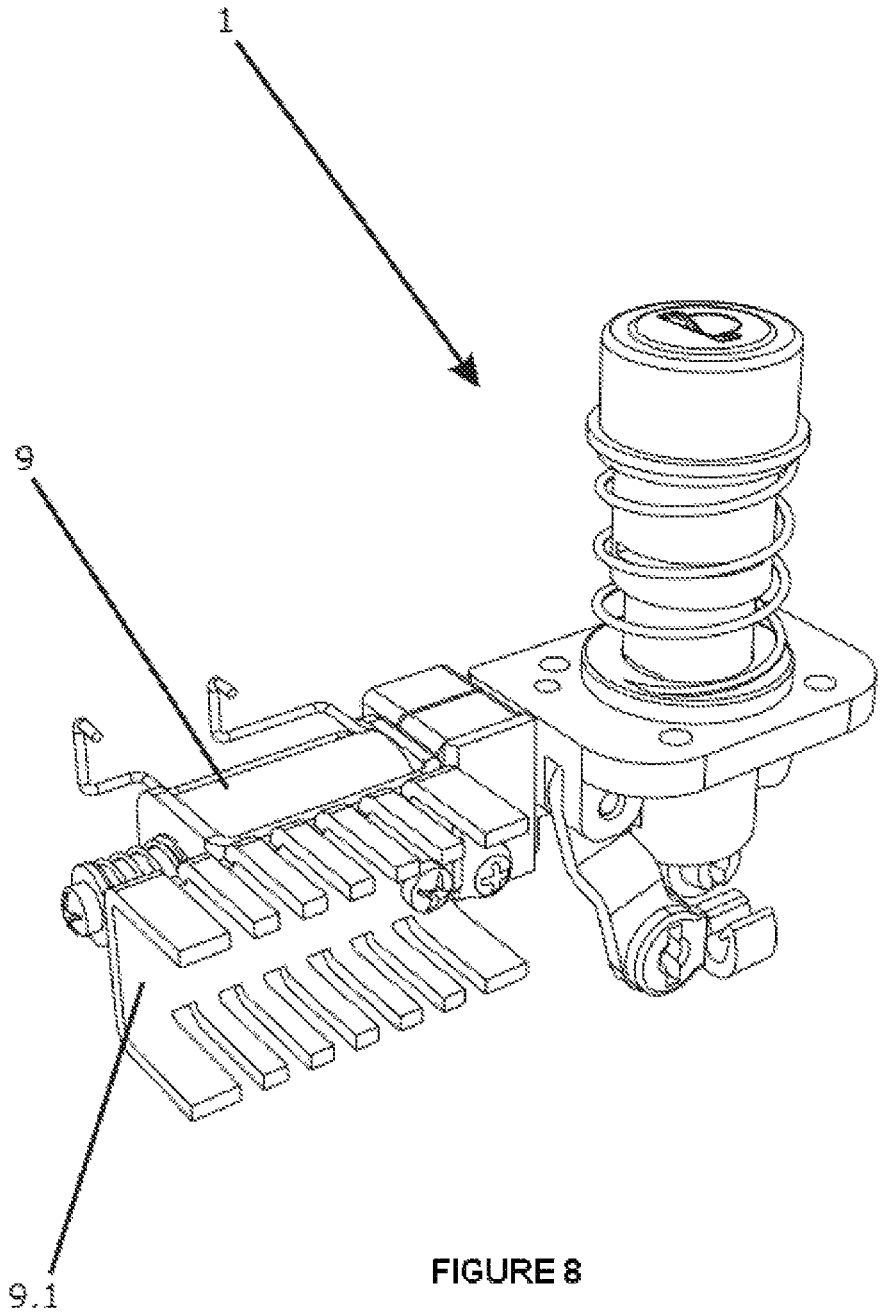
FIG. 8 illustrates a first optional version of the locking mechanism, seen in an isometric perspective view.

With reference to FIG. 8, it can be observed that the first optional version of the locking mechanism provides a locking mechanism (1) to which an electric actuator (9) is associated.

The electric actuator (9) consists preferably of a solenoid, which can also be associated to a heat sink (9.1).

The electric actuator (9) is mounted to the fixed base (3) such that the displacement of its internal piston (not shown) is able to actuate the articulation of the articulated arms (4) in a manner similar to a manual actuation (when the main cylinder (2) is "pushed") of the mechanism (1) as previously described. The electric actuator (9) mounted to the fixed base (3) is thus associated with the locking mechanism for remote actuation thereof when an electrical signal is imposed on the electric actuator (9) and being capable of local manual activation. The electric actuator (9) may comprise a solenoid associated with a heat sink (9.1).

Thus, the first optional version of the locking mechanism provides the possibility of remote activation through an electrical signal imposed on the electric actuator (9), and/or local activation, through the manual activation of the main cylinder (2).

Description of the Second Optional Version of the Locking Mechanism

Figure 9:
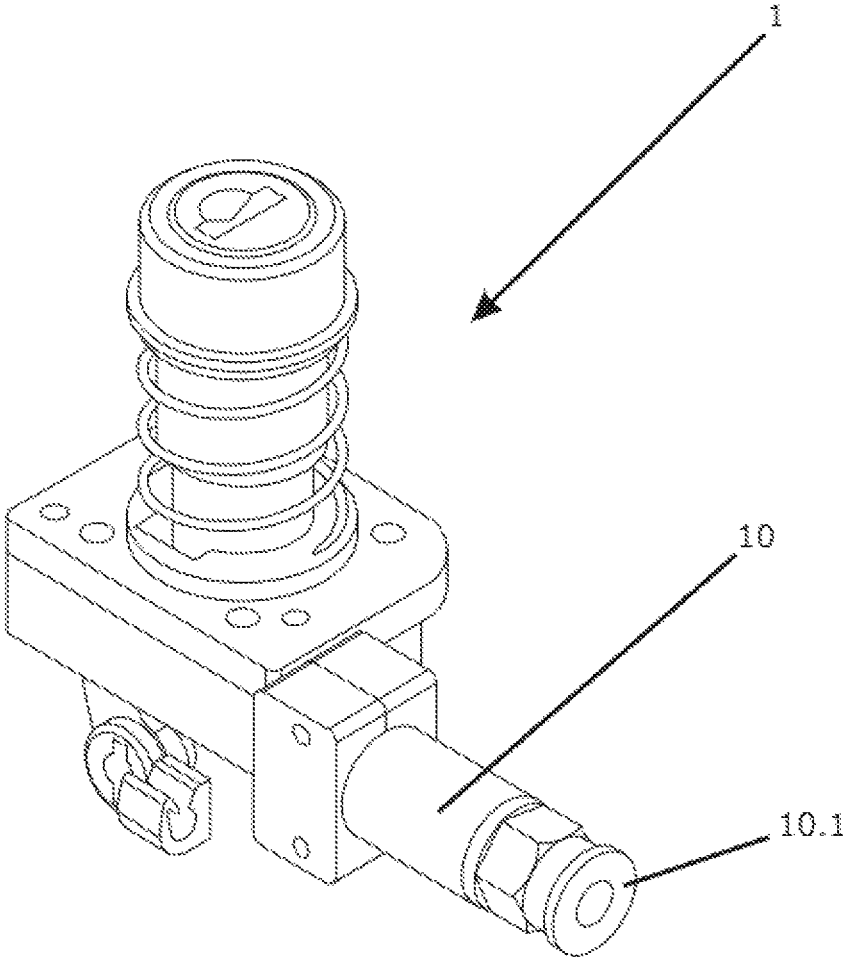
FIG. 9 illustrates a second optional version of the locking mechanism, seen in an isometric perspective view.

Based on FIG. 9, it can be observed that the second optional version of the locking mechanism provides a locking mechanism (1) to which a pneumatic actuator (10) is associated.

The pneumatic actuator (10) consists preferably of a pneumatic valve, which can also be associated with a fast coupling connector (10.1).

The pneumatic actuator (10) is mounted to the fixed base (3) such that the displacement of its internal piston (not shown) is able to actuate the articulation of the articulated arms (4) in a manner similar to the manual actuation when the main cylinder (2) of the mechanism (1) is pushed as previously described.

Thus, the second optional version of the locking mechanism provides the possibility of remote activation through a pneumatic signal imposed on the pneumatic actuator (10) and/or local activation through the manual activation of the main cylinder (2). The pneumatic actuator (10) mounted to the fixed base (3) is thus associated with the locking mechanism for remote activation when a pneumatic signal is imposed on the pneumatic actuator (10) and is also capable of providing local manual activation. The pneumatic actuator may comprises a pneumatic valve associated with a fast coupling connector (10.1).

Advantages of the Inventive Locking Mechanism

Based on the whole context explained above, it is evident to realize that the main model, as well as the optional versions of the locking mechanism provide a constructiveness free of mechanical movement extenders, particularly parts and mechanisms with rotational movement. Moreover, the local activation of the locking mechanism herein disclosed consists of a "Push-To-Open" type, i.e. "push to open", and this operation is also differentiated with respect to similar devices belonging to the current state of the art.

The invention claimed is:

1. A locking mechanism comprising:

a main cylinder;

a fixed base;

a pair of articulated arms each arm equipped with a rod holder;

wherein the main cylinder has a cylindrical partially tubular body having an end suitable for receiving a core lock, an end of the main cylinder located opposite to the end suitable for receiving the core lock having a slot diametrically disposed forming two solid semicircular walls, each semicircular wall having a latitudinal passing hole; the latitudinal passing holes being aligned;

the fixed base being a monobloc body provided with a centrally disposed hole of circular contour, one face of the fixed base having two articulation tabs arranged spaced apart and aligned by the centrally disposed hole;

each articulation tab being formed by two parallel walls spaced apart by a gap, each parallel wall incorporating a latitudinal passing hole; the latitudinal passing holes of one articulation tab being aligned to each other;

wherein the pairs of articulated arms comprise bodies with an "L" shaped profile, each articulated arm having a horizontal extension followed by a vertical portion; each articulated arm having three through holes; a first through hole being oblong and shaped at an end of the horizontal extension of each articulated arm, a second through hole being circular and arranged at an end of the vertical extension of each articulated arm, and a third through hole being circular and arranged at a center, in a region where a 90° curve defines the "L" shaped profile of the articulated arm; the first through holes of the articulated arms (4) receiving the rods holders; and, wherein the pair of arms are pivotably mounted to the fixed block by a pair of pins disposed within the third through holes of each arm and the latitudinal passing holes of the two articulation tabs, the vertical extensions extending upwardly relative to the fixed base, the two articulation tabs disposed on opposite sides of the centrally disposed hole, the pair of arms being pivotably connected to the main cylinder by a common in passing through the first through holes of the pair of arms and the aligned latitudinal passing holes of the main cylinder, the main cylinder being reciprocally movable axially within the centrally disposed hole, relative to the fixed block, reciprocal movement of the main block displacing the horizontal extensions therewith, pivoting the pair of vertical extensions outwardly away from each other or inwardly towards each other.

2. The locking mechanism according to claim 1 further comprising an electric actuator mounted to the fixed base and associated with the locking mechanism for remote actuation thereof when an electrical signal is imposed on the electric actuator and being capable of local manual activation.

3. The locking mechanism of claim 2 wherein the electric actuator is a solenoid associated with a heat sink.

4. The locking mechanism according to claim 1 further comprising a pneumatic actuator mounted to the fixed base and associated with the locking mechanism for remote activation when a pneumatic signal is imposed on the pneumatic actuator and being capable of providing local manual activation.

5. The locking mechanism of claim 4 wherein the pneumatic actuator comprises a pneumatic valve associated with a fast coupling connector.

* * * * *